US005655396A

United States Patent [19]

Siler

[11] Patent Number: 5,655,396

[45] Date of Patent: Aug. 12, 1997

[54] ROLL PEENING DEVICE

[75] Inventor: Ernest Ray Siler, Beavercreek, Ohio

[73] Assignee: General Motors Corporation, Detroit, Mich.

[21] Appl. No.: 533,033

[22] Filed: Sep. 25, 1995

[51] Int. Cl.[6] ..... B21D 17/04

[52] U.S. Cl. ..... 72/75; 29/243.517

[58] Field of Search ..... 72/75, 126; 29/243.517, 29/898.044

[56] References Cited

U.S. PATENT DOCUMENTS

| | | | |
|---|---|---|---|
| 1,842,571 | 1/1932 | Sebell | 72/75 |
| 2,564,617 | 8/1951 | Welebny | 29/243.517 |
| 2,953,047 | 9/1960 | Stillwagon, Jr. | 72/75 |
| 3,239,887 | 3/1966 | Weber | 18/19 |
| 3,528,271 | 9/1970 | DiPonio | 72/108 |
| 3,827,270 | 8/1974 | Neilsen | 72/199 |
| 4,253,223 | 3/1981 | Neilsen | 29/90 |
| 4,292,829 | 10/1981 | Weber et al. | 72/76 |
| 4,478,299 | 10/1984 | Dorosz | 175/369 |
| 4,596,472 | 6/1986 | Vezirian | 384/96 |
| 4,730,681 | 3/1988 | Estes | 175/39 |
| 4,974,434 | 12/1990 | Reccius et al. | 72/53 |
| 5,092,412 | 3/1992 | Walk | 175/372 |

*Primary Examiner*—Lowell A. Larson
*Attorney, Agent, or Firm*—Jeffrey A. Sedlar

[57] ABSTRACT

A roll peening device includes a shank having a head with an annular groove that carries at least one ball which is held therein by a retainer such that the application of the ball to a workpiece in combination with rotating motion causes deformation of the workpiece and is particularly useful in a process of retaining a part in an opening.

3 Claims, 2 Drawing Sheets

ROLL PEENING DEVICE

BACKGROUND OF THE INVENTION

The present invention relates to a device and a method for retaining a part in an opening. More particularly, the invention relates to a roll peening device for retaining a part in an opening and the method of retaining a part in an opening related thereto.

A need often exists to maintain two component parts of a mechanism in an assembled relationship. The known devices and methods through which this result is achieved are numerous. Such known mechanisms include: threaded engagement, staking, pressing, adhesion and retention through use of a collateral device such as a retaining ring. In spite of these numerous known methods and their attendant advantages and shortcomings, a seemingly endless quest exists to develop new means of retention. This quest is driven by the fact that newly developed assemblies which include unique component part arrangements or provide unique functions stress the existing portfolio of known means of retention. Often a means of retention that is developed with a particular application in mind is found advantageous in existing applications that had used conventional retaining means that, while adequate, are proven less than optimum once a new means of retention is discovered.

In spite of the past prolific activity in the art of retention, it has been found that a new means of retaining a part within an opening is desirable. This desirability has arisen within the context of anti-lock braking systems for vehicles.

In ABS systems a brake modulator typically comprises a body or a module of a rigid material such as metal with a plurality of internal passageways communicating between open bores in the module. The open bores in the module carry such items as solenoid valves which control the flow of fluid through the passageways of the module. It is desirable that the solenoid valves of the ABS modulator be located in close proximity to one another in the module. Conventionally, solenoids are retained in their individual bores in the module by commonly known means of retention such as retaining rings. This tends to result in somewhat of a costly means of retention for an individual unit with several solenoids.

SUMMARY OF THE INVENTION

It is an aim of the present invention to provide a new means of retaining a part in an opening which reduces assembly costs in terms of expense and weight. Other apparent advantages have also resulted from the present invention wherein a roll peening device provides a new method of retaining a part in an opening.

The roll peening device includes a shank which is readily loadable within a rotating machine. The shank includes an operative end which includes a head having an annular groove. At least one but preferably a plurality of balls are carried in the annular groove by a retainer which works in cooperation with the head of the shank. The balls protrude from the head and the retainer such that they are rotatably engageable with a workpiece surface. By rotating the roll peening device and applying thrust such that the balls are forced against the workpiece surface, a resulting deformation of the workpiece around the opening provides an integral means of retaining the part in the opening.

The present invention also includes a method of retaining a part in an opening using the aforementioned roll peening device. Once the part is properly placed within the opening in the workpiece, the roll peening device is lowered over the part such that the balls engage the workpiece. A selective application of force and rotation is applied to the roll peening device by a driving machine causing the material of the workpiece to integrally retain the part in the hole. When a selected amount of material is cause to flow into the opening retaining the part, the roll peening device is retracted and retention is complete.

In one specific embodiment of the present invention wherein the roll peening device is used to retain a solenoid in an ABS module, the use of a conventional snap ring form of retention is avoided. In this application, the thickness of the workpiece, specifically the module, can be reduced by approximately 5 millimeters, saving material and reducing weight. In addition, the solenoids being retained in the module can be placed closer together than is possible with conventional snap ring retention since there is no need to form a snap ring groove in the module.

Although the roll peening device according to the present invention has been developed with a specific application in mind, namely an ABS modulator, its wide range and applicability is apparent. As an option for some applications, the shank of the roll peening device may be formed with an axial bore extending through the head such that the part being retained may extend above the workpiece itself.

DETAILED DESCRIPTION OF THE PRESENTLY PREFERRED EMBODIMENT

Figure 1:
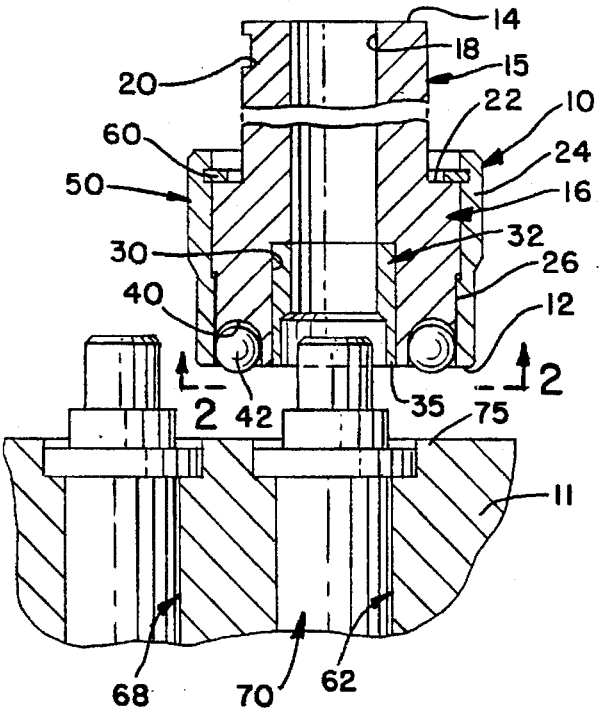
FIG. 1 is a fragmentary cross-sectional view of a roll peening device adjacent a workpiece.

Referring to the drawings, illustrated in FIG. 1 is a roll peening device 10 which includes an operative end 12 and a drive end 14. The roll peening device 10 generally comprises a shank 15 which includes a head 16. The shank is generally of an elongated cylindrical configuration and may be solid or include an axial opening 18 which in the present embodiment extends completely therethrough. Axial opening 18 may be omitted or extend only partially into the shank through the head 16 depending on the given application. The shank includes a flattened area designated as seat 20 providing a means to positively lock the shank against rotation in the associating drive machine (not illustrated).

Figure 3:
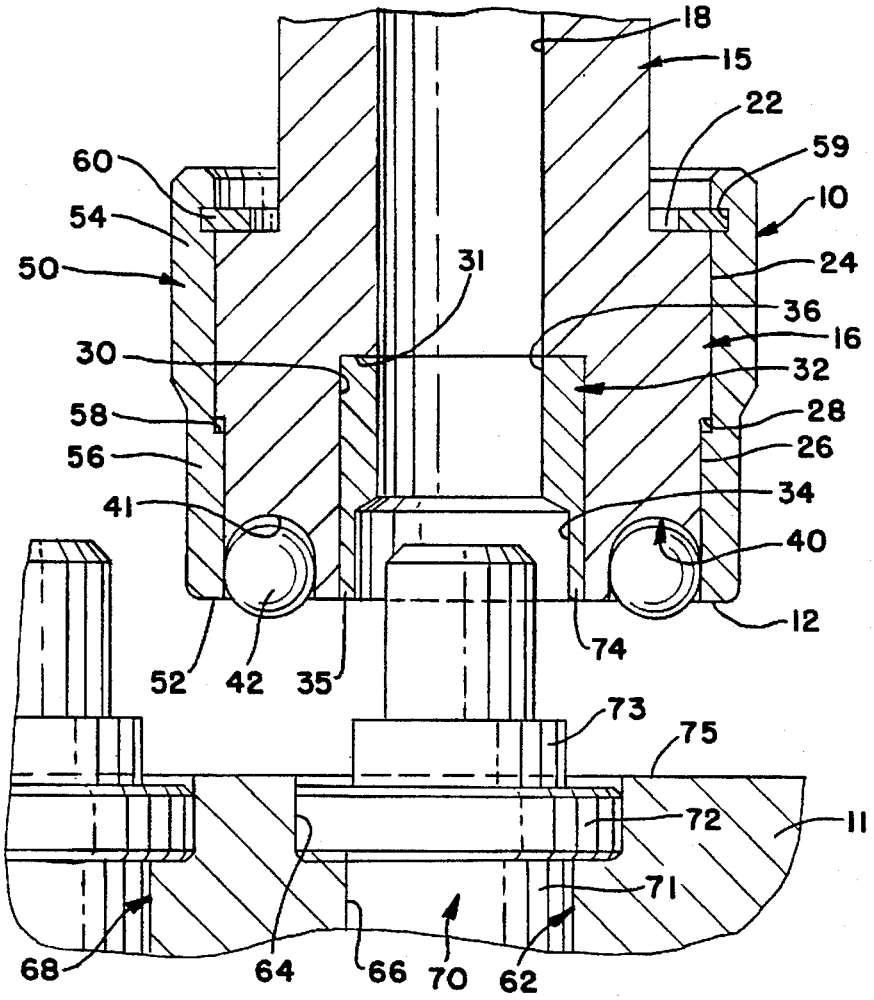
FIG. 3 is a fragmentary cross-sectional view of the pre-application stage of a roll peening device to a workpiece.

Referring additionally to. FIG. 3, the head 16 comprises a generally cylindrical configuration which is larger in diameter than the remainder of shank 15 so as to form an annular shoulder 22. The head 16 also includes a stepped configuration with larger diameter section 24 and smaller diameter section 26 forming an annular shoulder 28 therebetween. The head 16 also includes an axial opening segment 30 which is larger in diameter than the remainder of the axial opening 18.

The difference in diameters between the axial opening 18 and segment 30 comprises a cavity for housing an insert, designated as guide 32, which in the present case is made of brass and includes an inner opening of a stepped configuration with a larger diameter section 34 and a smaller diameter section 36. The guide 32 is pressed into the axial opening 30 and seats against an annular shoulder 31 which places the end 35 adjacent the operative end 12 of the roll peening device 10.

The operative end 12 of roll peening device 10 includes an annular groove 40 which carries a plurality of balls representative of which is ball 42. The ball 42 comprises a hardened steel spherical element which is generally alloyed or plated with chromium.

Figure 2:
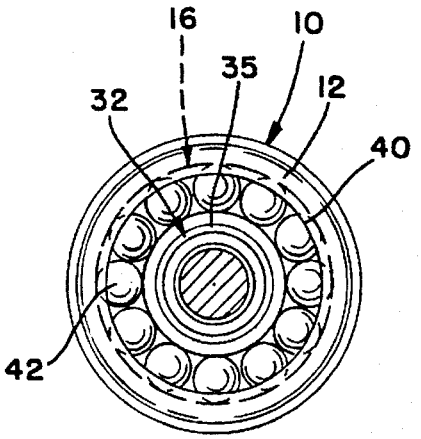
FIG. 2 is a sectional view taken generally through the plane indicated by the line 2—2 in FIG. 1.

With additional reference to FIG. 2, it is apparent that the maximum number of balls contained in the annular groove 40 will be dependent upon the relative size of the ball 42 to the head 16 however it is not necessary that the entire annular groove 40 be filled with balls. Specifically, the number of balls is directly relative to the specific application within which the roll peening device 10 will be utilized. Also, as will be apparent to one skilled in the art, the larger the number of balls contained in annular groove 40 the greater the force that must be applied to roll peening device 10 in applying the balls 42 to the workpiece 11 (shown in FIG. 1), to cause material to flow for a given degree of rotation. Therefore, although the annular groove 40 is illustrated filled with a maximum number of balls it is only necessary that at least one ball 42 be present in the annular groove 40.

Again directing reference to FIG. 3, retainer 50 is carried on the head 16 and includes an inward annular leg 52 for retaining the ball 42 in the annular groove 40. The retainer 50 includes a first cylindrical section 54 which mates with segment 24 of head 16 and a second cylindrical section 56 which mates with the segment 26 of head 16. At the juncture of cylindrical sections 54 and 56 annular shoulder 58 is formed. The annular shoulder 58 is engageable with the annular shoulder 28 of head 16 to provide a stop for the maximum travel of the retainer 50 onto the head 16. Retainer 50 also includes an inner annular groove 59 which carries a retaining ring 60. The retaining ring 60 is expandedly fixed in inner annular groove 59 and is engageable with annular shoulder 22 to maintain the retainer 50 on the head 16. A small amount of vertical float is provided for the retainer 50 wherein at one limit annular shoulder 58 engages annular shoulder 28 and at the opposite limit retainer ring 60 engages annular shoulder 22.

The specific design of the roll peening device 10 is intended to matingly engage with the workpiece 11. The workpiece 11 includes an opening 62 which has a stepped bore configuration with first bore segment 64 being larger in diameter than second bore segment 66. In this specific instance the workpiece 11 is a module block for an ABS system and therefore, a second opening 68 is located in close proximity to the first opening 62. The opening 62 has inserted therein a part and specifically, a solenoid 70 which includes a first segment 71 which is received within bore segment 66 a second segment 72 which is seated within bore segment 64 and a third and fourth segment 73 and 74 respectively, which protrude from the workpiece 11. The segment 72 is seated within the bore segment 64 such that a portion of the workpiece 11 designated as 75 exists at a point outwardly on workpiece 11 from the segment 72.

Figure 4:
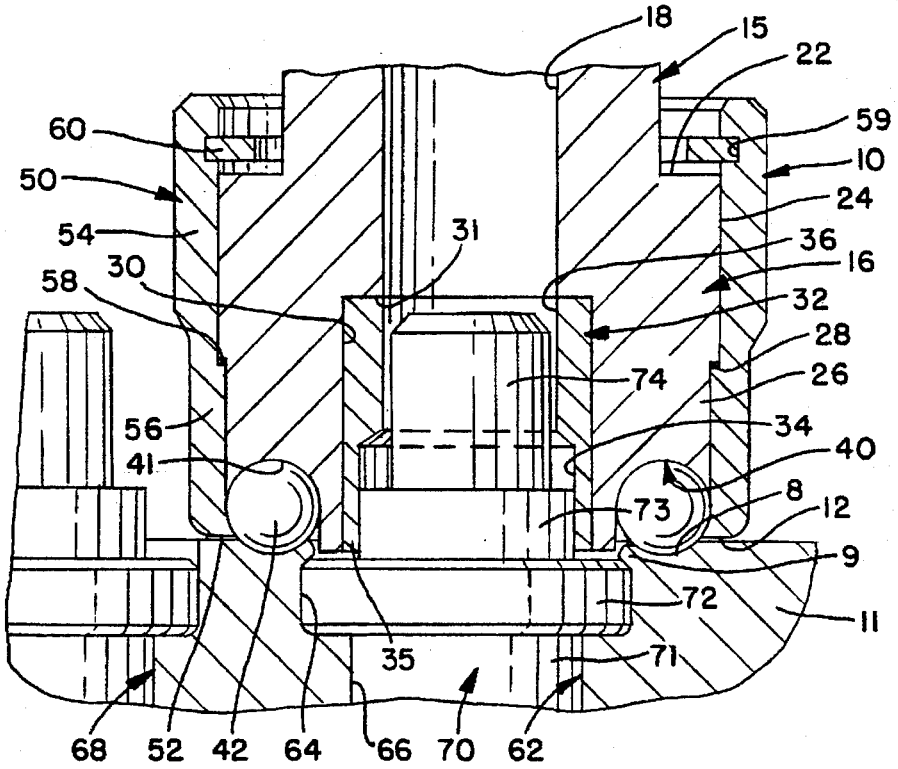
FIG. 4 is a fragmentary cross-sectional view of the application stage of a roll peening device to a workpiece.
Figure 5:
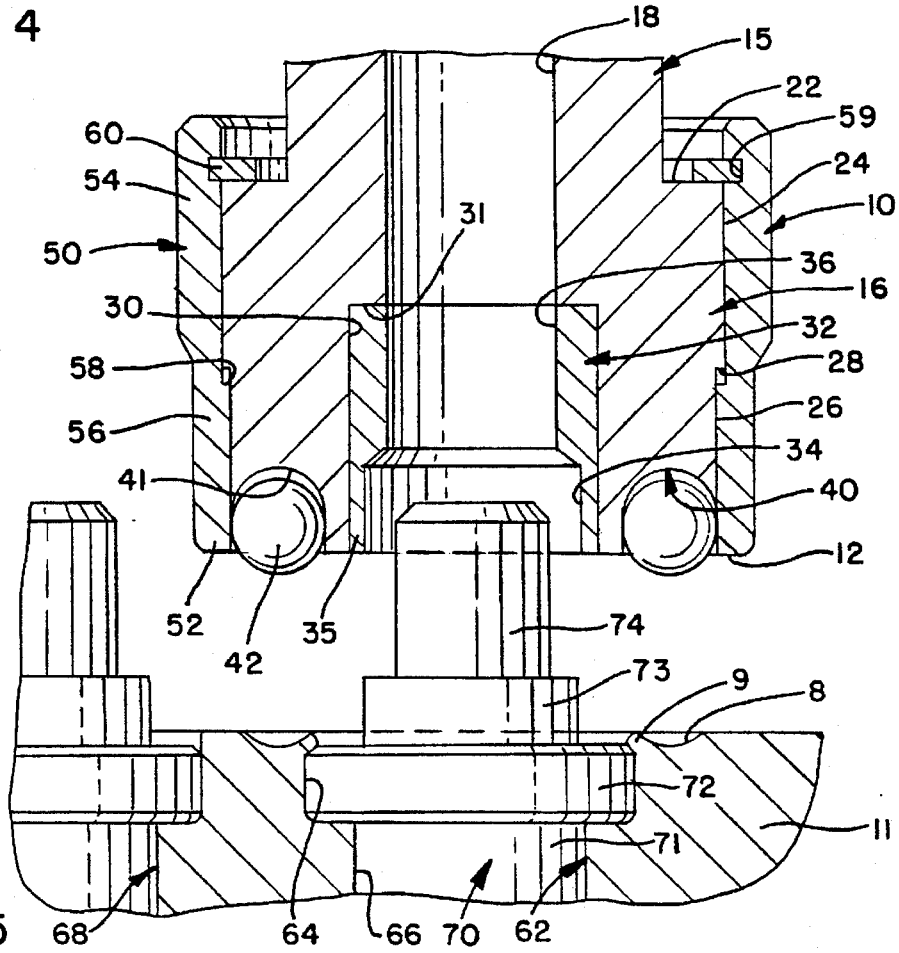
FIG. 5 is a fragmentary cross-sectional view of the retracting stage of a roll peening device to a workpiece.

FIGS. 3, 4 and 5 illustrate progressively, the process of retaining the part 70 in the opening 62 of the workpiece 11. In FIG. 3 the part 70 is inserted into the opening 62 with the roll peening device 10 being applied there-over. FIG. 4 shows the application of the roll peening device 10 to the workpiece 11. The guide 32 assists in directing the roll peening device 10 over the part 70 with cylindrical section 34 receiving segment 73 and cylindrical section 36 receiving segment 74. The guide 32 may or may not be required depending upon a particular application for which the roll peening device 10 is utilized. The ball 42 is directed to the bottom 41 of annular groove 40 and the retainer 50 floats upward on the head 16. Force is applied through the shank 15 to the ball 42 and therethrough to the workpiece 11.

Through the application of force and rotation of the roll peening device 10 a section of the workpiece 11 designated as annular leg 9 is caused to flow over the section 72 of part 70 securing the part in opening 62. The amount of deformation required in forming the annular leg 9 depends on the given application. In addition to deformation of the workpiece 11 the heat accompanying the application of force and rotating motion thereto results in a localized annealing process that is regulated by the amount of speed and force applied resulting in a strengthening of the area of the workpiece 11 around annular leg 9.

Referring to FIG. 5, the roll peening device 10 is shown being retracted from the workpiece 11 with the annular leg 9 now forming an integral means of retention securing the part 70 in the opening 62. An annular groove 8 remains around the opening 62 from which material has moved to form the annular leg 9. The close proximity of the opening 68 to the opening 62 means that the annular groove (not illustrated), which will be formed upon the application of roll peening device 10 to the opening 68 will overlap with the annular groove 8 about opening 62. It is to be found that this overlap does not hinder the method of retention according to the present invention. Through means of the foregoing structure a relatively inexpensive method of retaining a part in an opening is provided without applying large forces to the part itself.

What is claimed is:

1. A roll peening device comprising:

a shank having a head with an annular groove wherein the head includes first and second annular shoulders;

a ball rotatably positioned in the annular groove;

a retainer having a generally cylindrical body with a first end having an inward annular leg, the retainer positioned about the head so that the inward annular leg engages the ball holding the ball within the annular groove wherein the retainer includes a second end with an internal groove and includes a third annular shoulder; and a retaining ring positioned in the internal groove wherein the retainer floats on the head between a first position where the retaining ring engages the first annular shoulder to hold the retainer on the head and a second position where the third annular shoulder engages the second annular shoulder and the retaining ring is disengaged from the first annular shoulder.

2. A roll peening device according to claim 1 wherein the shank includes an axial opening extending through the head wherein the roll peening device is used to secure a part in a workpiece and further comprising a guide carried in the axial opening wherein the guide is spaced away from the ball and wherein the guide includes first and second cylindrical segments wherein the guide assists in directing the roll peening device over the part by receiving the part within the first and second cylindrical openings and wherein the annular groove has a bottom and wherein the ball is spaced away from the bottom when the roll peening device is spaced away from the workpiece and wherein the ball is engaged with the bottom when the roll peening device engages the workpiece and as the retainer moves from the first position to the second position and wherein the ball always extends outwardly from the retainer as the retainer floats.

3. A roll peening device according to claim 2 wherein the roll peening device is used to secure a plurality of parts in close proximity in a workpiece wherein a space between adjacent parts is less than the space required for two annular grooves formed by the roll peening device in the workpiece to secure the parts in the workpiece.

* * * * *